US007318586B2

(12) United States Patent
Leuthold

(10) Patent No.: US 7,318,586 B2
(45) Date of Patent: Jan. 15, 2008

(54) METHOD AND DEVICE FOR STACKING SHEET MATERIAL

(75) Inventor: Karlheinz Leuthold, Munich (DE)

(73) Assignee: Giesecke & Devrient GmbH, Munich (DE)

( * ) Notice: Subject to any disclaimer, the term of this patent is extended or adjusted under 35 U.S.C. 154(b) by 130 days.

(21) Appl. No.: 10/523,248

(22) PCT Filed: Jul. 30, 2003

(86) PCT No.: PCT/EP03/08434

§ 371 (c)(1),
(2), (4) Date: Jan. 27, 2005

(87) PCT Pub. No.: WO2004/013025

PCT Pub. Date: Feb. 12, 2004

(65) Prior Publication Data

US 2005/0253322 A1 Nov. 17, 2005

(30) Foreign Application Priority Data

Jul. 31, 2002 (DE) ..... 102 34 970

(51) Int. Cl.
*B65H 29/00* (2006.01)

(52) U.S. Cl. ..... 271/187; 271/315

(58) Field of Classification Search ..... 271/315, 271/187

See application file for complete search history.

(56) References Cited

U.S. PATENT DOCUMENTS 3,531,108 A * 9/1970 Gingras et al. ..... 271/305
3,851,773 A * 12/1974 Kluge et al. ..... 414/788.3
4,470,590 A * 9/1984 Ariga et al. ..... 271/187
4,501,418 A * 2/1985 Ariga et al. ..... 271/187
4,593,896 A * 6/1986 Nakamura ..... 271/186
4,595,193 A * 6/1986 Nakamura ..... 271/187
4,603,849 A * 8/1986 Nakamura et al. ..... 271/186
4,629,174 A * 12/1986 Wakisaka et al. ..... 271/186

(Continued)

FOREIGN PATENT DOCUMENTS

DE 44 37 722 A 4/1996

(Continued)

*Primary Examiner*—David H Bollinger
(74) *Attorney, Agent, or Firm*—Rothwell, Figg, Ernst & Manbeck, PC

(57) ABSTRACT

A spiral slot stacker has a two-part stripper 2 for stripping out sheet material from a stacker wheel 1. The two parts 2*a*, 2*b* of the stripper are movable. A first part 2*a* of the stripper is moved out of the stacker wheel together with the last bank note 100 to be stacked in such a way, that only the last bank note is stripped out and the next bank note 101 remains in the stacker wheel. The second part 2*b* of the stripper at this stage rotates along with the stacker wheel and will not be locked in the strip-out position until the spiral slot stacker is prepared for stacking a next bank-note stack. The bank notes, in the meanwhile supplied to the stacker wheel, are stripped out from the stacker wheel by the second part 2*b* of the stripper, while the first part 2*a* of the stripper is moved back to the strip-out position. By this method a collision of the first part of the stripper with the bank notes located in the stacker wheel is prevented.

14 Claims, 4 Drawing Sheets

U.S. PATENT DOCUMENTS 5,104,282 A * 4/1992 Gleason ..... 414/790.3
5,359,930 A * 11/1994 Hansen ..... 101/232
5,641,156 A * 6/1997 Nukada et al. ..... 271/176
5,899,448 A * 5/1999 Hosking ..... 271/3.08
6,131,903 A * 10/2000 Schaefer et al. ..... 271/312
6,581,927 B2 * 6/2003 Claudio ..... 271/187
2005/0023746 A1 * 2/2005 Michler et al. ..... 271/187
2005/0242498 A1 * 11/2005 Sato ..... 271/302

FOREIGN PATENT DOCUMENTS

JP 58-113067 7/1993

* cited by examiner

METHOD AND DEVICE FOR STACKING SHEET MATERIAL

CROSS-REFERENCE TO RELATED APPLICATION

This application is a National Phase of International Application Serial No. PCT/EP03/08434, filed Jul. 30, 2003.

FIELD OF THE INVENTION

The invention relates to a method for stacking sheet material as well as a spiral slot stacker, in particular for the use in a bank note processing apparatus.

DESCRIPTION OF THE BACKGROUND ART

In conventional bank note processing machines the bank notes generally are singled in a stack and led past a sensor device by means of a transport path. The individual bank notes are checked by sensors of the sensor device and dependent on the checking result are supplied to certain final destinations or stacker units.

For checking the bank notes several sensors can be provided, which judge the bank notes according to different criteria. Accordingly, several stacker units are available, which stack the bank notes of the different categories into units of an adjustable piece number. If for example bank notes of a certain category are to be stacked in units of a piece number of 100 bank notes, it is necessary to perform a separation in the continuous flow of bank notes between the one hundredth bank note and the following bank note meant for the same stacker after the one hundredth bank note has arrived at the stacker.

In connection with this, from DE-PS 34 12 725 it is known to use two stackers for bank notes of the same category. If 100 bank notes are placed in the respectively active stacker, the following bank notes will be supplied to the second identically constructed stacker via a diverter in the transportation system. In this known solution it is necessary to provide two stackers of the same construction and the respective required space.

From EP-OS 0 119 814 is known a solution, which requires only one stacker per bank note category. For this purpose on the stacker is provided a separation element. At first this separation element is in an idle position until, analogously to the above-mentioned example, 100 bank notes have been stacked. After that the separation element is inserted into the flow of bank notes between the one hundredth bank note and the bank note following thereupon in such a way, that the following bank notes are temporarily stored on the separation element. Meanwhile, the stacked unit of bank notes can be emptied. After the emptying the temporarily stored bank notes are stored in the stacker. The separation element returns to its idle position.

This solution has the disadvantage, that with higher transportation speeds a relatively high actuating power for accelerating the separation element has to be summoned, which can only be achieved with a correspondingly high effort. With such a high transportation speed a reliable operation of the stacker cannot be guaranteed.

In DE 44 37 722 A1 it is proposed to interrupt the delivery of bank notes to the transportation system instead, when the sensor device detects that the predetermined piece number of a category has been reached. The bank notes of the same category already singled at this point of time are temporarily stored in the sorter, until the ready stacked bank-note stack has been removed. The temporary storage can be performed in the stacker itself or in a buffer path integrated in the transport path. This solution has the general disadvantage that the machine due to the interruption works in a discontinuous fashion.

In the solution in which the already singled bank notes are stored in the stacker itself, the stacker has the form of a spiral slot stacker, as for example described in DE-OS 32 32 348. However, the stripper for stripping out the bank notes accommodated in the slots of the stacker wheel is designed to be movable in such a way that it can be moved out of the stacker wheel or into the stacker wheel. The components interact with each other in such a way that the movable stripper when moving out of the stacker wheel strips out the one hundredth bank note onto the stack deposit, and that the bank notes located in the next slots of the stacker remain therein. In the meantime, the stacker wheel further rotates and accommodates the bank notes which had already been singled at the point of interruption. As soon as the stack deposit is emptied and prepared for stacking a next bank-note stack, the stripper again is moved into the stacker wheel. Then the stacking operation is continued in the usual fashion.

The disadvantage in this solution is that the stacker wheel has to be stopped, so as to enable the stripper to move again into the stacker wheel. Because with a rotating stacker wheel there exists the danger that the stripper collides with the bank notes located in the slots, before it has reached its strip-out position. However, this means that the transportation system does not only have to be interrupted as soon as the predetermined piece number of a category has been reached, but potentially once again when the stripper is moved back into the stacker wheel.

SUMMARY OF THE INVENTION

It is the problem of the present invention to propose a method and an apparatus for stacking sheet material, in which the delivery of bank notes to the transportation system not necessarily has to be interrupted when the predetermined piece number of a category has been reached, or that such an interruption time at least is kept short.

This inventive solution starts out from a spiral slot stacker according to DE 44 37 722 A1, in which the sheet material is temporarily stored in the stacker wheel. I.e., for example the one hundredth bank note is stripped out from the stacker wheel by means of a movable stripper, while the bank notes in the next slots remain in the stacker wheel. In so far herewith reference is made to DE 44 37 722 A1 including the constructive proposals for solution described therein.

As to prevent the stripper from colliding with the bank notes located in the stacker wheel when moving into the stacker wheel or having to stop the stacker wheel as to avoid such a collision, the stripper is formed at least in a two-part fashion, only a first part being moved out of the stacker wheel in the described fashion. At the time the first part of the stripper is moved out of the stacker wheel, the second part of the stripper is released from its strip-out position. The second part of the stripper is movable, too. It is, however, not moved out of the stacker wheel but rotates along with the stacker wheel after having been released from the strip-out position. Meanwhile, further bank notes are supplied to the stacker wheel, in such a way that the delivery of bank notes to the transportation system of the bank note processing machine has not to be interrupted.

There are two alternative embodiments:

According to the first embodiment, the second part of the stripper rotates along with the stacker wheel until the stack deposit is prepared to receive a next bank-note stack and the second part of the stripper again has reached its strip-off position. Then it is again locked in the strip-off position, the stacker wheel still further rotating. By this means it is achieved that the bank notes located in the stacker wheel are stripped out of the stacker wheel and stacked on the stack deposit by the second part of the stripper beginning with the moment of locking. Now the first part of the stripper can be moved back to its strip-out position on the same path on which it has been moved out of the stacker wheel. A collision with the bank notes located in the stacker wheel is excluded, since these are stripped out of the stacker wheel by the second part of the stripper.

However, in this solution, too, in rare cases it can occur, that a bank note provided for the spiral slot stacker cannot be introduced into a slot of the stacker wheel, this is the case when the supply is blocked by the moved-along second part of the stripper. Only few slots of the stacker wheel are affected by this blocking. The problem can be easily avoided by driving the stacker wheel in an accelerated fashion in this phase, so as to the respective slots are rapidly turned past the bank note supply position. If this is not sufficient as to avoid a collision of a bank note to be supplied to the stacker wheel with the rotating-along part of the stripper, it is expedient to integrate a buffer path into the transport path, as it is proposed in DE 44 37 722 A1 as a second alternative. In so far, too, reference is made to DE 44 37 722 A1.

According to the second embodiment the second part of the stripper rotating along with the stacker wheel is moved back to its strip-out position against the rotating direction of the stacker wheel and locked. This has the advantage that it is not moved past the bank note supply place and the supply of further bank notes to the stacker wheel thus is not blocked. However, this second embodiment is only practicable, when the second part of the stripper has not moved too far away from the stack deposit, since though the bank notes are stripped out of the slots when the second stripper part is moved back, they would not be stacked on the stack deposit in a reliable fashion. With this embodiment, therefore, it is important that the stack deposit is prepared as rapidly as possible for receiving the next bank-note stack to be stacked. This can be achieved, for example, by pushing aside the ready stacked bank-note stack or, according to a preferred embodiment, by moving an auxiliary stack deposit over the stack deposit with the ready stacked bank-note stack. As soon as the auxiliary stack deposit has taken its position, the moved-along second part of the stripper can be moved back to its strip-out position, the bank notes located in the stacker wheel slots in between being stripped out onto the auxiliary stack deposit. Then, again the first part of the stripper, which was moved out of the stacker wheel, is moved back into the stacker wheel. Then the stacking operation is continued in the usual fashion.

The auxiliary stack deposit and the stack deposit preferably are designed in the manner of a rake in such a way that they can be brought to the same level when the ready stacked bank-note stack has been removed from the stack deposit.

BRIEF DESCRIPTION OF THE DRAWINGS

In the following the invention is described by way of example with reference to the accompanying figures.

FIGS. 1*a* and 1*d* show a spiral slot stacker of a bank note processing machine at different points of operation. The bank note processing machine not shown in detail herein is constructed in a way as described in DE 44 37 722 A1, including transport systems, diverters, sensors and the like. Of course, the spiral slot stacker described in the following is also suitable for stacking sheet material in other apparatuses.

DETAILED DESCRIPTION OF THE INVENTION

Figure 1A:
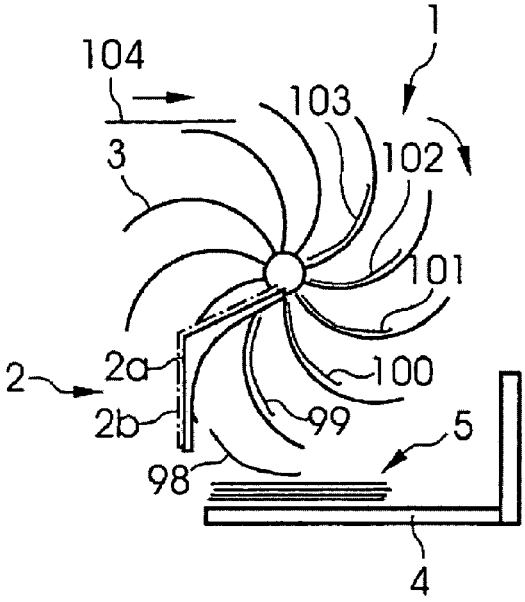
FIGS. 1*a* to 1*d* show a first embodiment of the invention.

The spiral slot stacker has a stacker wheel 1 with slots spirally disposed one behind the other around a rotational axis. The rotating direction of the stacker wheel is indicated by an arrow. To the stacker wheel 1 bank notes 98 to 104 are supplied successively. FIG. 1*a* shows the spiral slot stacker 1 just at the time the bank note 104 is supplied.

A stripper 2 in a usual fashion engages with the spiral slot stacker. For this purpose the slots accommodating the bank notes are formed by stacker wheel fingers 3 disposed side by side and spaced apart from each other, between which the stripper 2 with stripping fingers suitably adapted and disposed side by side moves into engagement. In FIG. 1*a* the spiral slot stacker is schematically shown in section, in such a way that merely one stripping finger and one stacker wheel finger plane is shown.

Due to the rotation of the stacker wheel 1 and the rotation of the stripper 2 engaging with the stacker wheel 1 the bank notes located in the stacker wheel 1 are transported towards the stripper 2, which successively strips out these bank notes from the slots of the stacker wheel 1 onto a stack deposit 4 located therebelow. By this means on the stack deposit 4 is formed a bank-note stack 5, to which at the time as shown in FIG. 1*a* the 98th bank note 98 is supplied.

Figure 1B:
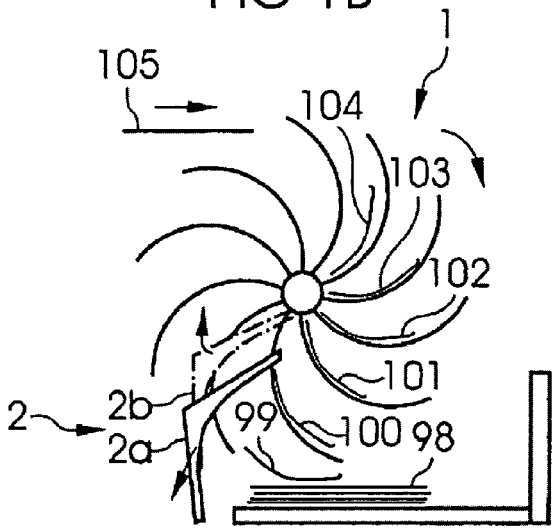

When the number of bank notes required for the bank-note stack 5, for example 100 bank notes, is reached, the stacking operation is interrupted, so that the bank-note stack 5 can be taken out from the stack deposit 4, before the stacking of the next bank-note stack begins. For this purpose the stripper 2, as described in DE 44 37 722 A1, is moved out of the stacker wheel 1 in such a specific way that the one hundredth bank note 100 is the last to be stripped out from the stacker wheel 1 onto the bank-note stack 5, as indicated in FIG. 1*b*.

In contrast to DE 44 37 722 A1, however, only a part 2*a* of the stripper 2 is moved out of the stacker wheel 1 roughly in the direction of the shown arrow, while a second part 2*b* of the stripper is moved along with the rotating stacker wheel 1. For this purpose each stripping finger of the stripper 2 is divided into two parts 2*a*, 2*b*. Alternatively, every second stripping finger can be designed as a moved-along stripping finger 2*b* and the remaining stripping fingers as stripping fingers 2*a* adapted to be moved out.

The movement of the stripper part 2*a* by suitable measures is correlated with the rotation of the stacker wheel 1 in such a way that the desired purpose is achieved, namely to strip out a specific bank note as a last bank note and to leave the next bank note in the stacker wheel. For this purpose the stripper part 2*a* can have a separate, electronically controlled drive or be designed to be mechanically coupled to a contour disk, as described in DE 44 37 722 A1.

A not shown locking of the second part 2*b* of the stripper 2 for fixing it in the strip-out position as shown in FIG. Ia is released at the time the first part 2*a* of the stripper 2 is moved out of the stacker wheel I. As to achieve the result that the second part 2*b* of the stripper 2 rotates along with the stacker wheel 1, there can be provided a separate drive. But the effort connected with a separate drive can be avoided, when the second part 2*b* of the stripper in the moment of being released from the locking is coupled to the stacker wheel 1. For this purpose the stripper is connected to the driving shaft of the stacker wheel 1 via a not shown coupling and locked in its strip-out position by means of a release mechanism 7 or is released via the release mechanism 7 after having stripped out the one hundredth bank note, so that it synchronously rotates with the stacker wheel 1. Instead of a mechanical release mechanism the coupling can have the design of a magnetic coupling adapted to be electrically actuated.

Figure 1C:
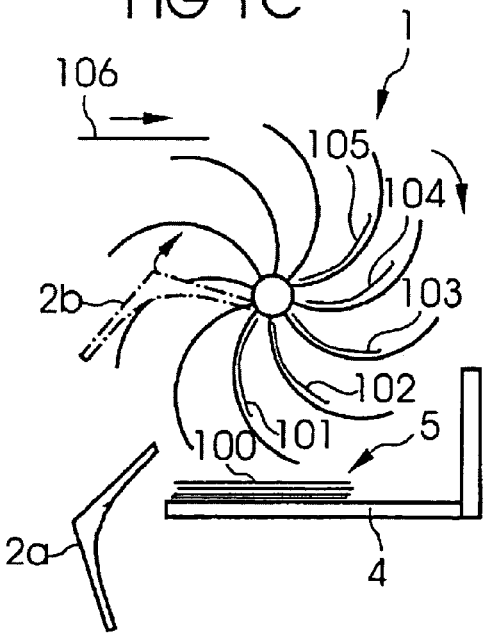

FIG. 1*c* shows the stacker wheel 1 with the rotating-along part 2*b* of the stripper 2 and the first part 2*a* of the stripper 2, which is completely moved out of the stacker wheel 1, after the one hundredth bank note 100 was stripped out onto the bank-note stack 5. Meanwhile, the 106th bank note 106 is transported to the stacker wheel 1.

Figure 1D:
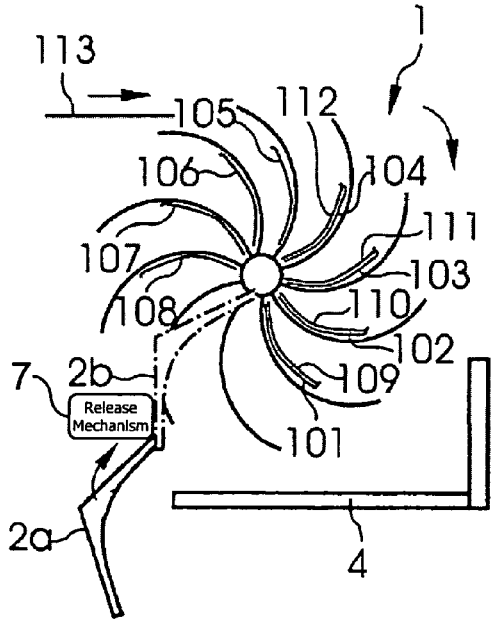

Now the bank-note stack 5 is removed from the stack deposit 4, so as to prepare the stack deposit for receiving the next bank-note stack. After having prepared the stack deposit 4 for receiving a next bank-note stack, the stacker wheel 1 further rotates until the second part 2*b* of the stripper 2 again has reached the strip-out position according to FIG. 1*a*. This is shown in FIG. 1*d*. Since in the meanwhile further bank notes 107 to 112 have been supplied to the stacker wheel 1, in individual slots of the stacker wheel 1 are located two or, optionally, more bank notes, when the second part 2*b* of the stripper 2 again reaches its strip-out position. The second part 2*b* of the stripper 2 then again is locked in the strip-out position, in such a way that the bank notes located in the slots of the stacker wheel are stripped out onto the stack deposit 4 by the second part 2*b* of the stripper 2 in the usual fashion. Then the first part 2*a* of the stripper 2 can be moved back to the strip-out position, too. A collision with the bank notes located in the stacker wheel is not possible here, since in the meanwhile these bank notes are stripped out by the second part 2*b* of the stripper 2. For this reason, in particular the stacker wheel 1 needs not to be stopped, when the first part 2*a* of the stripper 2 is moved back to the strip-out position.

Figure 2A:
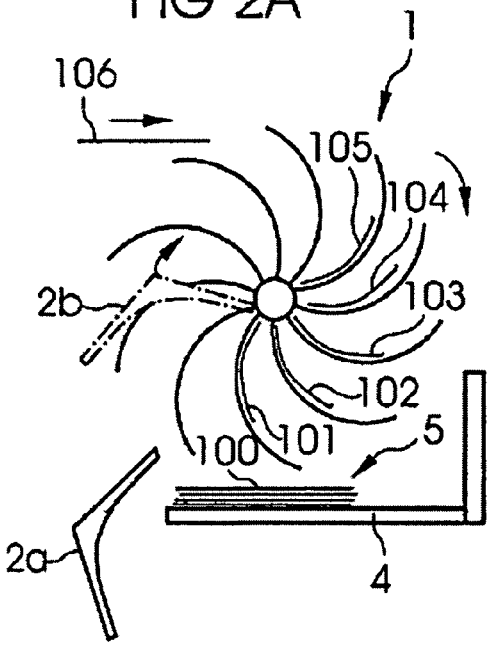
FIGS. 2*a* and 2*b* show a second embodiment of the invention.
Figure 2B:
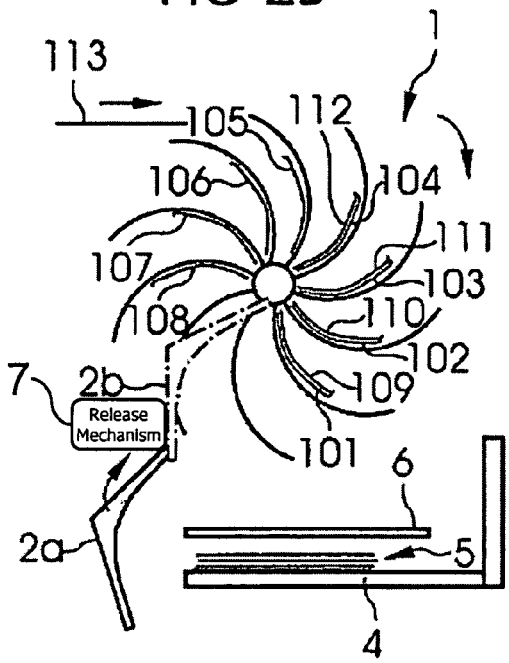

In FIGS. 2*a* and 2*b* a second embodiment of the spiral slot stacker is shown, which in principle works in the same way as the embodiment previously described with respect to the FIGS. 1*a* to 1*d*. FIG. 2*a* shows the stacker wheel 1 at the same time of operation as in FIG. 1*c*. The procedure of the method in so far is identical. In contrast to the embodiment according to FIGS. 1*a* to 1*d*, after completing the bank-note stack 5 by stripping out the one hundredth bank note 100, an auxiliary stack deposit 6 is introduced between the stacker wheel 1 and the bank-note stack 5, in such a way that the spiral slot stacker is considerably faster prepared for stacking a next sheet material stack. By this means the moved-along second part 2*b* of the stripper again can be locked in the strip-out position as early as after one revolution of the stacker wheel 1.

Preferably, the stack deposit 4 and the auxiliary stack deposit 6 are designed in a comblike fashion. At first the stack deposit 4 together with the bank-note stack 5 is lowered, so that the auxiliary stack deposit 6 can be positioned thereabove. After the bank-note stack 5 has been removed from the stack deposit 4, the stack deposit is lifted to the level of the auxiliary stack deposit 6 with the bank notes 101, 109, 102, 110 etc. temporarily stored thereon in such a way that the teeth of the two deposits 4 and 6 engage in a comblike fashion and constitute a joint deposit level. As to prevent a collision of the auxiliary stack deposit 6 with the first part 2*a* of the stripper 2 moved out of the stacker wheel 1, the introduction of the auxiliary stack deposit 6 is performed, for example, in a direction parallel to the axis of rotation of the stacker wheel.

Figure 3A:
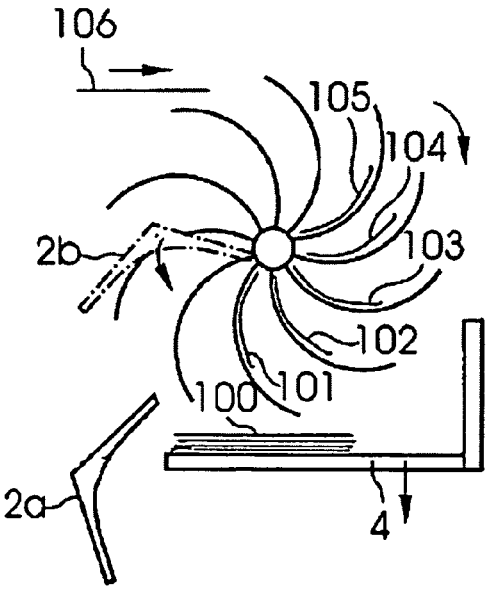
FIGS. 3*a* and 3*b* show a third embodiment of the invention.
Figure 3B:
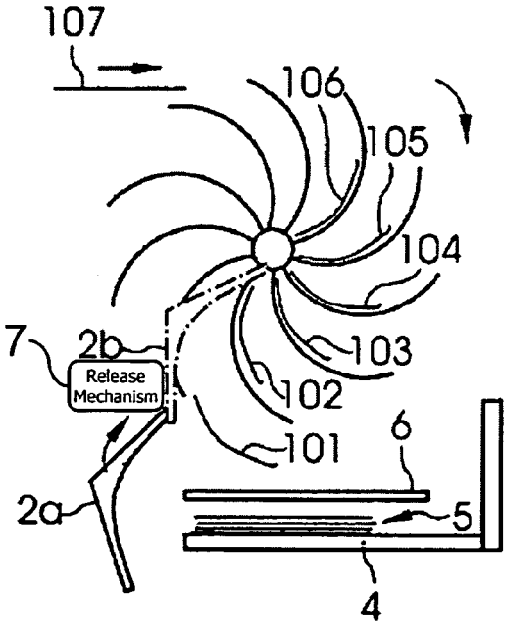

As recognizable from FIGS. 1*a* to 1*d* and 2*a*, 2*b*, the supply of further bank notes to individual slots of the stacker wheel 1 is temporarily blocked by the second part 2*b* of the stripper 2 which is rotating along with the stacker wheel 1. If these slots cannot be moved past the bank note supply location, before the stacker wheel 1 is supplied with a next bank note, this next bank note has to be temporarily stored, for example in a buffer path integrated in the transport path. The technical effort required for such a buffer path can be avoided, when the spiral slot stacker is designed as shown in FIGS. 3*a*, 3*b*. Here again the auxiliary stack deposit 6 is employed, which enables the beginning of stacking a next bank-note stack even before the bank-note stack 5 has been removed from the stack deposit 4.

FIG. 3*a* shows the spiral slot stacker in the same position as in FIG. 2*a*. In contrast to the embodiments described until now, the second part 2*b* of the stripper 2, however, is moved along with the stacker wheel 1 only as long as the one hundredth bank note 100 has been stripped out onto the stack deposit 4. Then the stack deposit 4 is lowered, the auxiliary stack deposit 6 is positioned over the lowered stack deposit 4, and the second part 2*b* of the stripper 2 is moved back to the strip-out position in an opposite direction as the rotating direction of the stacker wheel 1. FIG. 3*b* shows the stacker wheel 1 with the second part 2*b* of the stripper 2 moved back to the strip-out position and the introduced temporary stack deposit 6. The stripping out of the first bank note 101 for the next bank-note stack begins with the moving back of the second part 2*b* of the stripper 2 to the strip-out position and is completed roughly at the time when the auxiliary stack deposit 6 has reached its position for stacking the next bank-note stack.

Figure 4:
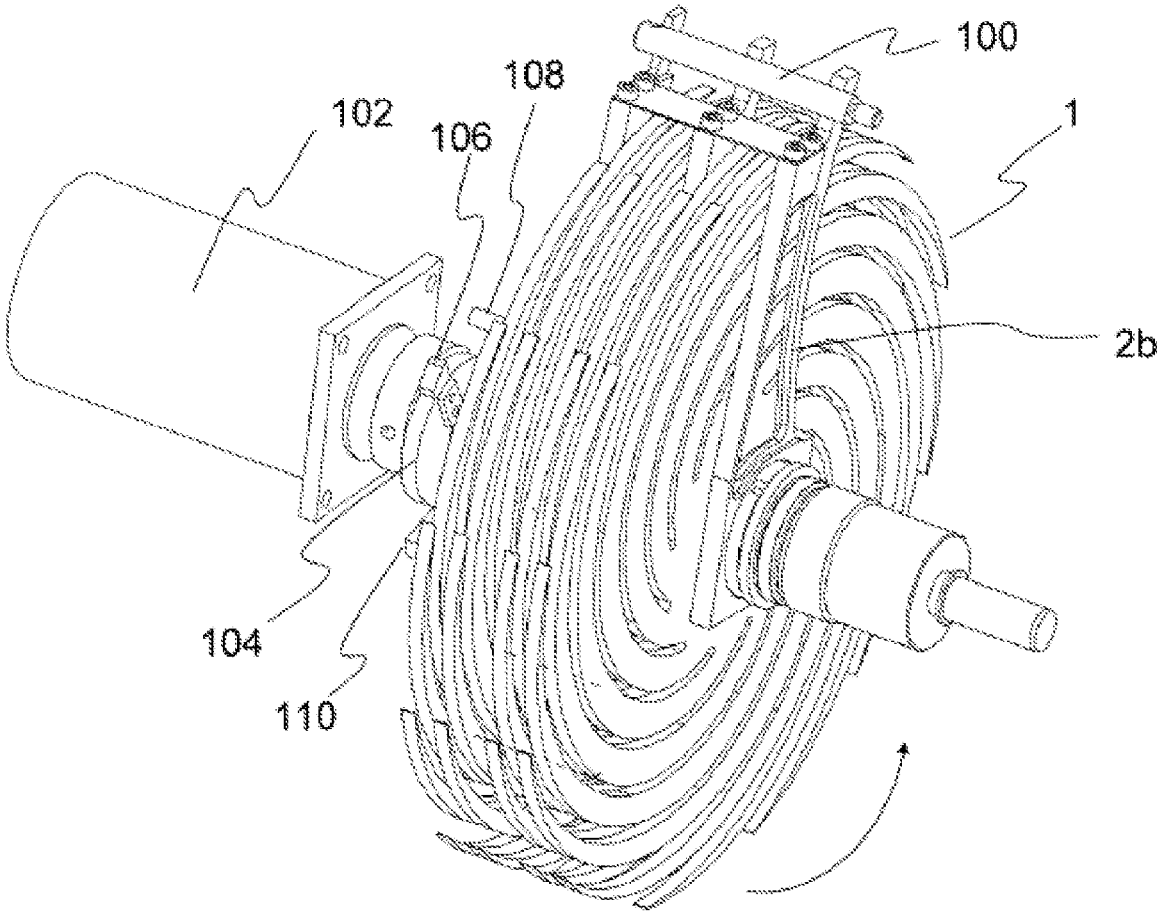
FIG. 4 shows a partial exploded view of a stacker wheel with a stripper part and a drive therefore.
Figure 5:
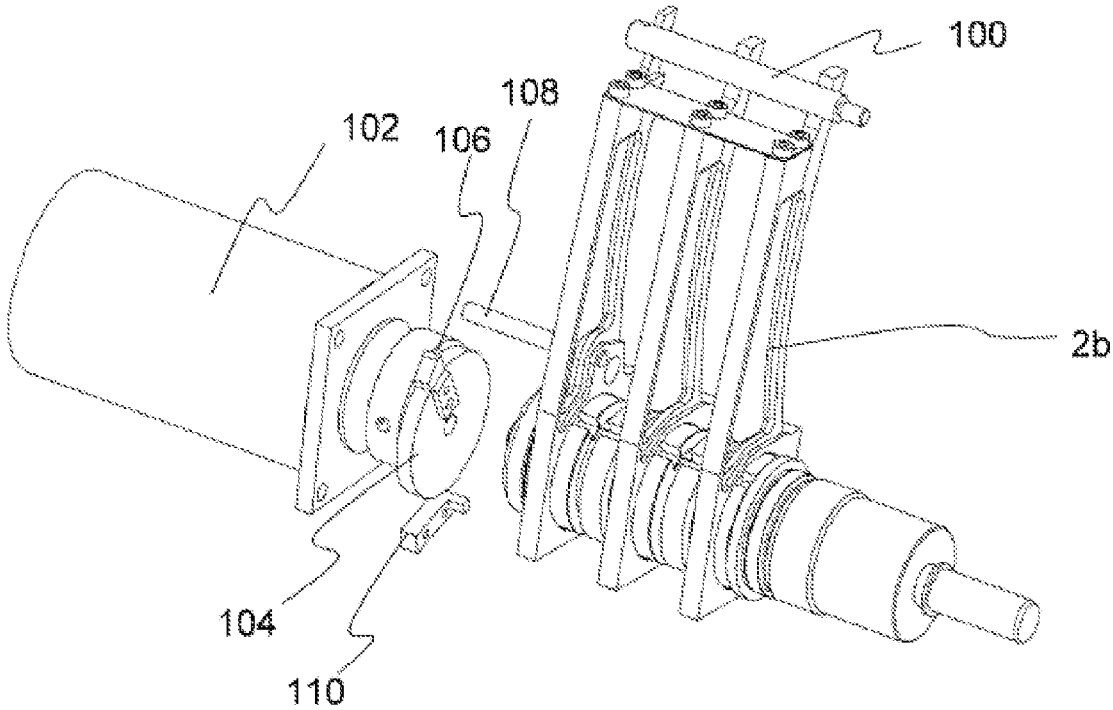
FIG. 5 corresponds to the view in FIG. 4, without the stacker wheel.
Figure 6:
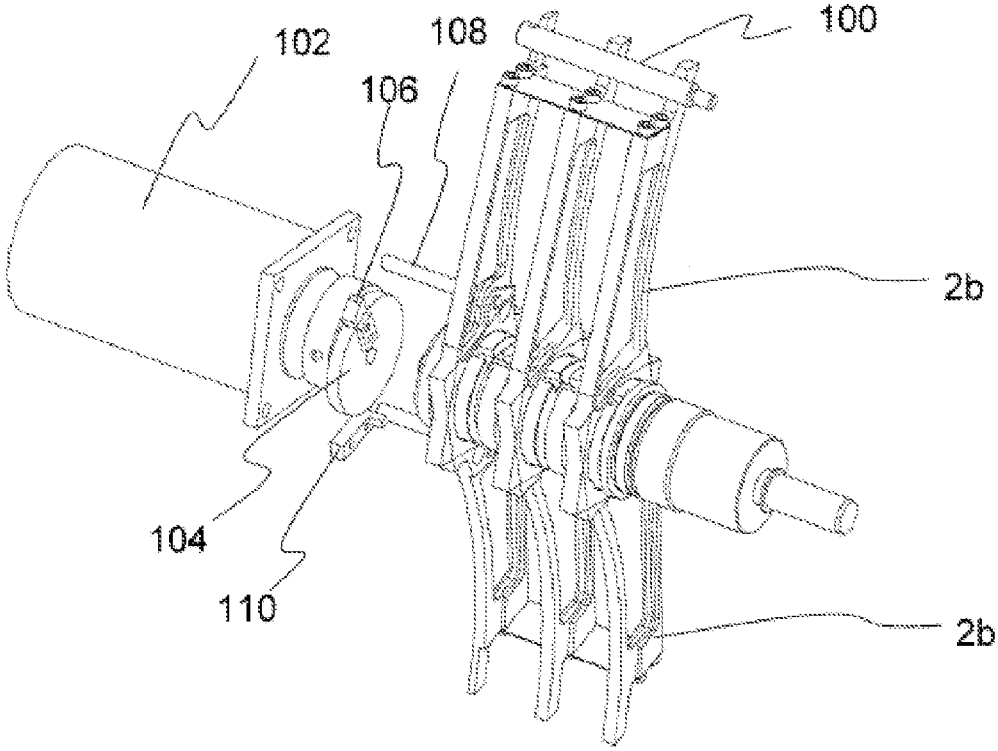
FIG. 6 corresponds to the view in FIG. 5, with the stripper part shown in two extreme positions.

As is shown in FIGS. 4, 5 and 6, the stripper part 2*b* and the stacker wheel 1 are arranged on a common axis. The stripper part 2*b* is mounted by means of a dragging clutch so that it will move along with the stacker wheel 1 whenever no other forces or torques are acting on the stripper part 2*b*. Movement in the direction of rotation of the stacker wheel 1 (see arrow in FIG. 4) is limited by a stopper 100, thus defining the upper position in FIGS. 4, 5 and 6.

A stepper motor 102 is used to move the stripper part 2*b* in the opposite direction. The shaft of the stepper motor 102 is arranged coaxially with respect to the axis of the stacker wheel 1, and is connected to a disc 104 bearing a radially extending engaging piece 106. An engaging rod 108, attached to the stripper part 2*b*, is arranged such that it is moved by the engaging piece 106. Thus, by activating the stepper motor 102, the stripper part 2*b* can be moved against the direction of rotation of the stacker wheel 1 via the engaging piece 106 and the engaging rod 108. Control of the stepper motor 102 can be simplified by limiting the movement of the engaging rod 108 by means of an additional stopper 110. In this manner, the engaging rod 108 and the stripper part 2*b* can be locked in the lower position, as shown in FIG. 6. When the stepper motor 102 is powered off, the stacker wheel 1 moves the stripper part 2*b* back by means of the dragging clutch. Alternatively, the stripper part 2*b* may be coupled to the shaft of the stepper motor 102, either directly or via a transmission, so that the stripper part 2*b* is moved and locked by means of the stepper motor 102 alone.

The above-described dragging clutch may be replaced with an electrically actuatable magnetic clutch, in which the shafts of the clutch are coupled with the stacking wheel 1 and the stripper part 2*b*. In order to move the stripper part 2*b* along with the stacking wheel 1, the magnetic clutch is closed, otherwise, the magnetic clutch is open. Alternatively, the stopper 110 may be replaced with an electrically actuatable latch. In this case, a simple motor is used instead of the stepper motor 102, and the latch may be arranged such that it permits the engaging rod 108 to pass, in its locked state, when the engaging rod 108 rotates against the direction of rotation of the stacker wheel, and blocks the engaging rod 108 when it rotates in the direction of rotation of the stacker wheel. Thus, the motor turns the stripper part 2*b* of the engaging rod 108 to such an extent that the engaging rod 108 passes the latch. The motor can then be powered off so that the stripper part 2*b* is locked by means of the latch and the force of the dragging clutch. In order to move the stripper part 2*b* with the stacker wheel 1, it is sufficient to electrically release the latch. Of course, there are other options that may achieve the desired function, as known in the art.

Now the first part 2*a* of the stripper 2, without a danger of collision with the bank notes located in the stacker wheel 1, can be moved into the stacker wheel 1. After the banknote stack 5 being removed from the deposit plate 4, the stack deposit 4 is lifted in the fashion described hereinbefore to the level of the auxiliary stack deposit 6, and the said auxiliary stack deposit can be moved out of its comblike engagement with the stack deposit 4.

The invention claimed is:

1. Spiral slot stacker for stacking sheet material, comprising:

a stacker wheel with slots spirally disposed one behind the other around a rotational axis for receiving the sheet material, a stripper including a first movable part and a second movable part, the first and second movable parts being movable into, and out of, respective first and second strip-out positions in which the first and second movable parts strip out the sheet material from the slots of the stacker wheel, and a stack deposit for stacking the sheet material stripped off the slots, wherein the first movable part of the stripper moves out of the first strip-out position, while the stacker wheel is rotating, in such a way that the sheet material is stripped out from one of the slots of the stacker wheel and the sheet material of a next slot remains in the stacker wheel, and wherein the second movable part of the stripper is lockable in the second strip-out position and, when released, moves out of the second strip-out position and rotates along with the rotating stacker wheel.

2. Spiral slot stacker according to claim 1, characterized by an auxiliary stack deposit, which is adapted to be moved between the stack deposit and the stacker wheel.

3. Spiral slot stacker according to claim 2, characterized in that the auxiliary stack deposit and the stack deposit are adapted to be brought to the same level and to engage in a comblike fashion.

4. Spiral slot stacker according to claim 2, characterized in that the auxiliary stack deposit and the stack deposit are adapted to be brought to the same level and to engage in a comblike fashion.

5. Bank note processing apparatus comprising one or several spiral slot stackers according to claim 4.

6. Bank note processing apparatus comprising one or several spiral slot stackers according to claim 2.

7. Bank note processing apparatus comprising one or several spiral slot stackers according to claim 3.

8. Spiral slot stacker according to claim 1, characterized in that the second part of the stripper is adapted to be moved back to the strip-out position in an opposite direction to the rotating direction of the stacker wheel.

9. Bank note processing apparatus comprising one or several spiral slot stackers according to claim 8.

10. Bank note processing apparatus comprising one or several spiral slot stackers according to claim 1.

11. Method for stacking sheet material by means of a spiral slot stacker, which comprises a stacker wheel, which has slots spirally disposed one behind the other around a rotational axis for receiving the sheet material, comprising the following steps:

supplying the sheet material into the slots of the stacker wheel, stripping out the sheet material from the slots of the stacker wheel onto a stack deposit by means of a stripper being in a strip-out position for forming a sheet material stack, when a predetermined number of sheets is reached, moving a first movable part (2*a*) of the stripper out of the strip-out position, while the stacker wheel rotates, in such a way that the last sheet of the predetermined number of sheets is stripped out from the stacker wheel and the sheet material of a next slot remains in the stacker wheel, preparing the spiral slot stacker for stacking a next sheet material stack, moving back the first part of the stripper to the strip-out position, releasing a second movable part of the stripper from the strip-out position and moving along with the rotating stacker wheel, when the first part of the stripper is moved out of the strip-out position, further supplying sheets into the slots of the stacker wheel, while the second part of the stripper rotates along with the stacker wheel, locking the second moved-along part of the stripper in the strip-out position, when the spiral slot stacker is prepared for stacking the next sheet material stack, and stripping out the sheet material located in the slots by means of the locked second part of the stripper, while the first part of the stripper is moved back to the strip-out position.

12. Method according to claim 11, the step of preparing the spiral slot stacker for stacking a next sheet material stack comprising the following steps:

introducing an auxiliary stack deposit over the stack deposit for temporarily stacking the next sheet material stack thereon, removing the sheet material stack from the stack deposit, and bringing the auxiliary stack deposit, with the temporarily stacked sheet material stack, and the stack deposit to the same level, after the sheet material stack was removed from the stack deposit.

13. Method according to claim 12, the second part of the stripper being moved back in an opposite direction as the rotating direction of the stacker wheel, as to lock the said second part of the stripper in the strip-out position.

14. Method according to claim 11, the second part of the stripper being moved back in an opposite direction as the rotating direction of the stacker wheel, as to lock the said second part of the stripper in the strip-out position.

* * * * *